US011085243B2

(12) United States Patent
Al-Masri et al.

(10) Patent No.: US 11,085,243 B2
(45) Date of Patent: Aug. 10, 2021

(54) DRILL BIT CUTTER

(71) Applicant: Saudi Arabian Oil Company, Dhahran (SA)

(72) Inventors: Bakr Abdulrahim Al-Masri, Dhahran (SA); Naser Amer Al-Otaibi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 131 days.

(21) Appl. No.: 16/053,511

(22) Filed: Aug. 2, 2018

(65) Prior Publication Data

US 2020/0040660 A1 Feb. 6, 2020

(51) Int. Cl.
*E21B 10/567* (2006.01)
*E21B 10/42* (2006.01)

(52) U.S. Cl.
CPC ..... *E21B 10/567* (2013.01); *E21B 10/42* (2013.01)

(58) Field of Classification Search
CPC ..... E21B 10/567; E21B 10/42
USPC ..... 175/428
See application file for complete search history.

(56) References Cited

U.S. PATENT DOCUMENTS 5,078,219 A * 1/1992 Morrell ..... E21B 10/12 299/111
5,332,051 A 7/1994 Knowlton
5,437,343 A * 8/1995 Cooley ..... E21B 10/5673 175/431
5,456,522 A * 10/1995 Beach ..... E21C 35/183 299/106
5,645,323 A * 7/1997 Beach ..... E21B 10/50 299/111
6,145,607 A * 11/2000 Griffin ..... E21B 10/5735 175/426
6,615,934 B2 9/2003 Mensa-Wilmot
6,672,406 B2 1/2004 Beuershausen
6,935,444 B2 8/2005 Lund et al.
6,988,569 B2 1/2006 Lockstedt et al.
7,814,998 B2 10/2010 Patel et al.
8,112,258 B2 2/2012 Durairajan et al.
8,281,881 B2 10/2012 Tedeschi
9,708,858 B2 7/2017 King et al.
2006/0201712 A1* 9/2006 Zhang ..... E21B 10/567 175/57
2007/0235230 A1 10/2007 Cuillier et al.
2008/0156544 A1 7/2008 Singh et al.
2008/0264696 A1 10/2008 Dourfaye et al.
2010/0018780 A1 1/2010 Johnson et al.
(Continued)

FOREIGN PATENT DOCUMENTS

WO 2017087920 5/2017

OTHER PUBLICATIONS

International Search Report and Written Opinion issued in International Application No. PCT/US2019/044031 dated Oct. 15, 2019, 12 pages.

(Continued)

*Primary Examiner* — Matthew R Buck
*Assistant Examiner* — Patrick F Lambe
(74) *Attorney, Agent, or Firm* — Fish & Richardson P.C.

(57) ABSTRACT

A cutter for a drill bit to drill a formation. The cutter has a cylindrical substrate, and a cutting table that is superhard material coupled to the substrate. The cutting table along a direction away from the cylindrical substrate increases in width.

28 Claims, 7 Drawing Sheets

(56) References Cited

U.S. PATENT DOCUMENTS

| | | | |
|---|---|---|---|
| 2014/0124270 | A1 | 5/2014 | Durairajan et al. |
| 2017/0058615 | A1 | 3/2017 | Liang et al. |

OTHER PUBLICATIONS

GCC Examination Report in GCC Appln. No. GC 2019-38020, dated Jul. 19, 2020, 3 pages.

* cited by examiner

DRILL BIT CUTTER

TECHNICAL FIELD

This disclosure relates to wellbore drilling and associated drilling tools including drill bit cutters.

BACKGROUND

In the oil and gas industry, a drill bit is a tool to form a hole or wellbore in the Earth crust by rotary drilling. The drill bit may have multiple cutters. The wellbore may be formed for the discovery and extraction of hydrocarbons such as crude oil and natural gas. In wellbore drilling, a drill bit is attached to a drill string, lowered into a well, and rotated in contact with an Earth formation. Types of drill bits include fixed cutter bits and rolling cutter bits.

SUMMARY

An aspect relates to a cutter for a drill bit to drill a formation. The cutter has a cylindrical substrate, and a cutting table that is superhard material coupled to the substrate. The cutting table along a direction away from the cylindrical substrate increases in width.

Another aspect relates to a drill bit for drilling into a formation. The drill bit has a plurality of cutters. Each cutter has a substrate and a cutting table. The substrate has a support surface. The cutting table includes polycrystalline diamond (PCD) and is coupled to the support surface. A side of the cutting table along a direction opposite the substrate slopes outward such that a cutting surface of the cutting table is greater in diameter than the support surface.

Yet another aspect relates to a method of manufacturing a polycrystalline diamond compact (PDC) cutter for a drill bit, the PCD cutter including a cutting table and a cylindrical substrate. The method includes coupling the cutting table to the cylindrical substrate. The cutting table increases in diameter in a direction away from the cylindrical substrate. The cutting surface of the cutting table may be greater in diameter than the cylindrical substrate.

Yet another aspect relates to a method of drilling a hole in a formation, including lowering a drill bit having a cutter into the formation. The cutter has a cutting table coupled to a cylindrical substrate, wherein the cutting table includes polycrystalline diamond (PCD) and increases in diameter along a direction away from the cylindrical substrate. The method includes rotating the drill bit to drill the hole in the formation. The method maintains a Bakr angle of the cutter with respect to a surface of the formation greater than a back rake angle of the cutter with respect to the surface. The method includes removing formation rock cuttings from the formation.

The details of one or more implementations are set forth in the accompanying drawings and the description below. Other features and advantages will be apparent from the description and drawings, and from the claims.

DETAILED DESCRIPTION

Figure 1:
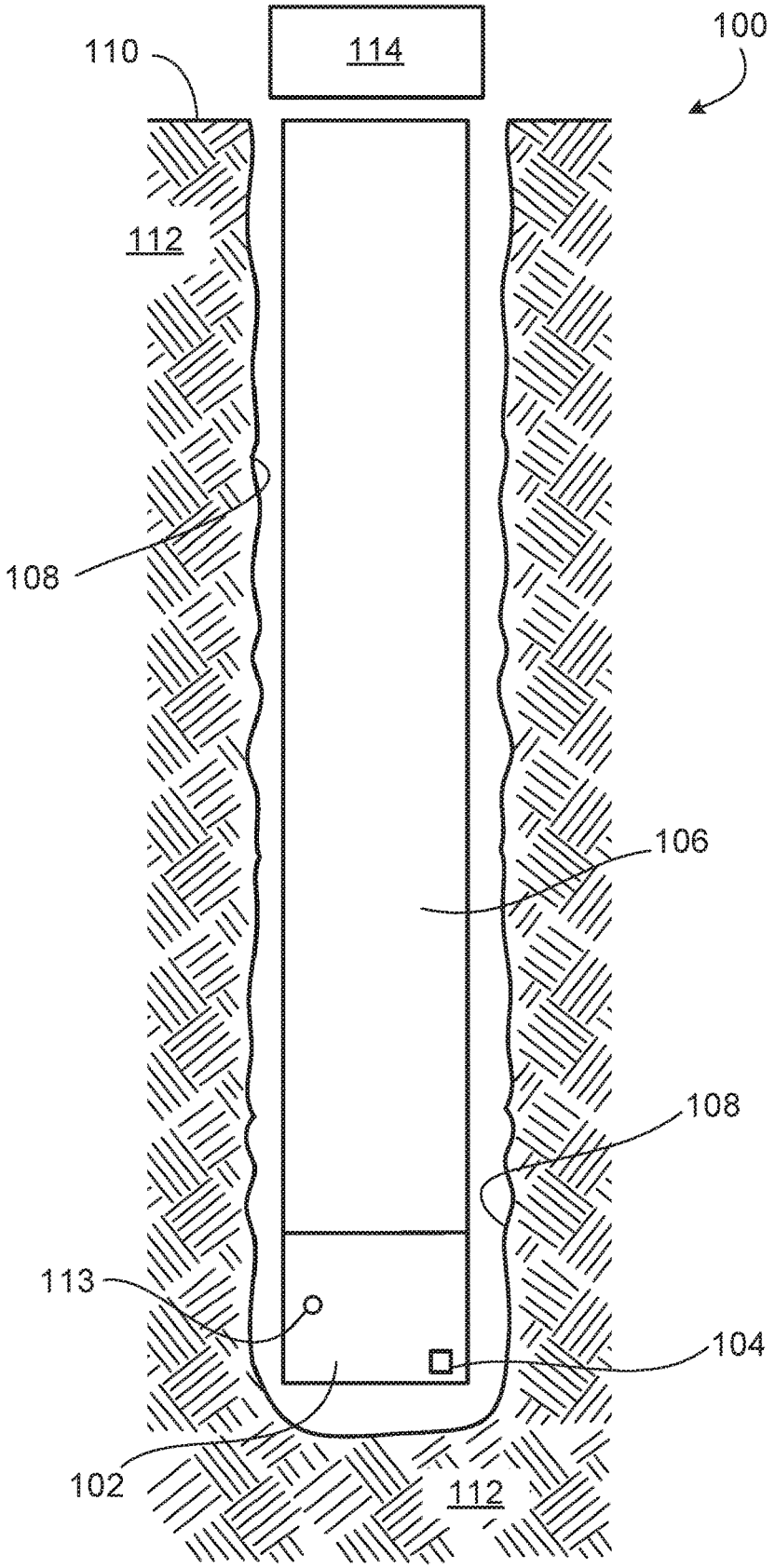
FIG. 1 is a diagram of a drill site including a drill bit disposed in a hole in an Earth formation.

Some aspects of the present disclosure may be directed to geometry of a drill bit cutter to extend life of the drill bit and drill bit cutter, and to promote a sharper cutting edge. During drilling, the innovative geometry may provide for the cylindrical substrate of the cutter to be lifted further off the bottom of the hole being drilled to extend cutter life.

An embodiment of the present techniques includes a polycrystalline diamond composite or compact (PDC) cutter having a flared diamond table increasing in diameter away from the substrate. Thus, compared to a conventional PDC cutter, the side surface area of the diamond table is increased which may lead to better cooling of the cutter in operation. Further, this cutter having a flared diamond table may position the substrate during drilling further from the bottom of the hole being drilled (as compared to conventional), and also increase the Bakr angle (defined below) with respect to the bottom hole. Moreover, some examples of the present cutter can fit into a typical or conventional PDC bit blade or seat. Lastly, in certain instances, a bit with this example cutter can employ the same back rake angle as with a conventional cutter.

In general, some embodiments include a cutter for a drill bit. The drill bit can drill a hole or wellbore in an Earth formation. The drill bit has a plurality of the cutters. The cutters may be installed, inserted, mounted, coupled, attached, or brazed into seats or blades on the drill bit. In these embodiments, a cutter includes a substrate and a cutting table (superhard material) coupled to the substrate. In particular, the cutting table may have a bottom surface sintered to a support surface or top surface of the substrate. The substrate may be cylindrical such as right solid cylinder. The superhard material may have a Vickers hardness of at least 40 gigapascals (GPa), or at least 70 GPa, and so on. The material may include synthetic diamond or real diamond. Indeed, the cutting table may be a diamond table. In certain examples, the drill bit is a PDC drill bit and the cutter a PDC cutter, wherein the superhard material includes polycrystalline diamond (PCD).

To improve performance of the cutter, the cutting table increases in width or diameter along a direction away from the substrate. Thus, the cutting table may have a top surface or cutting face greater in width or diameter than the substrate including the support surface of the substrate. See, for example, FIG. 5. The aforementioned direction can be along a central axis of the cutting table and of the substrate. See, for example, FIG. 6. As discussed below, the increasing width or diameter of the cutting table along a direction away from the substrate, and the cutting face being larger in width or diameter than the substrate, can facilitate: (1) a specified value of a Bakr angle between the cutter and a surface of the formation during drilling; and (2) a specified elevation of the substrate above the surface of the formation. In examples, such may extend life of the cutter or increase rate of penetration (ROP) of the drill bit into the wellbore. Indeed, examples herein for cutters, such as PDC bit cutters, have an innovative geometry of the cutters including a flared cutting table and associated angles of the cutting table. The present geometry may provide during drilling for the substrate of the cutters lifted or elevated more off the bottom of the hole as compared to other cutters to extend cutter life. Further, in some examples, the cutting edge is sharper than other cutters (including when the present cutters are worn while drilling) and thus may promote ROP.

In summary, the increasing in diameter of the cutting table (for example, diamond table) away from the substrate and the unique angles of the cutting table may lift the cutter substrate off the bottom of the hole being drilled to increase usage of the diamond table before reaching the substrate. Thus, life of the bit may increase. Furthermore, as indicated, the geometry may: (1) extend or increase surface area (as compared to conventional) of the side surface or backside of the diamond table which can lead to better cooling of the cutter; and (2) provide for the cutting edge angle to be sharper (including when the cutters are worn) than conventional design to benefit ROP. Lastly, as indicated, certain embodiments of the cutters having the aforementioned geometry can fit into typical PDC bit blades or seats and perform at the same back rake angle of the typical PDC bit.

In general, the rotation of a drill bit may break, grind, scrape, or fracture the Earth formation forming a wellbore or borehole. The drill bit may include a bit body, nozzles, blades, and cutters such as diamond cutters, and the like. As mentioned, one example of a drill bit is a PDC drill bit in which the cutters inserted into or installed on the drill bit have PCD material. Drill bits may be classified according to their cutting mechanism. Example types include rolling cone or rolling cutter bits, fixed head or fixed cutter bits, hybrid bits, and so on. Rolling cutter bits may drill by fracturing or crushing the formation with "tooth" shaped cutting elements on cone-shaped components that roll across the face of the borehole as the bit is rotated. Fixed cutter bits (or fixed head bits) may rotate as one piece and typically contain no separately moving parts. When fixed cutter bits employ PDC cutters, the bits may be labeled as PDC bits.

Fixed cutter bits generally employ a set of blades with very hard cutting elements or cutters to remove material by scraping or grinding action as the bit is rotated. The cutters may include natural or synthetic diamond. In fixed cutter bits, the cutters typically do not move relative to the bit. Thus, bearing or lubrication may be avoided in examples. Hybrid bits have a combination of features of rolling cutter bits, fixed cutter bits, or other bits, and may employ PDC cutters or other cutters constructed of hard material.

FIG. 1 is a drill site 100 which may be a location for oil exploration and production activities. The drill site 100 may be on-shore or an off-shore platform, and the like. Well drilling or borehole drilling may form a hole in the ground for the extraction or exploration of a natural resource such as ground water, brine, natural gas, petroleum, metallic ore, and so on. The drilling to form the hole can be for the injection of a fluid from surface to a subsurface reservoir, or for subsurface formations evaluation or monitoring, and so forth. The drill site 100 may be a workplace and equipment to drill an oil or gas well and establish associated infrastructure such as a wellhead platform. The drill site 100 may include a mounted drilling rig, pipeline, and storage tanks, and arrange for transport of crude oil and natural gas to processing facilities.

To form a hole in the ground, a drill bit 102 having multiple cutters 104 may be lowered into the hole being drilled. In operation, the drill bit 102 may rotate to break the rock formations to form the hole. In the rotation, the cutters 104 may interface with the ground or formation to grind, cut, scrape, shear, crush, or fracture rock to drill the hole. A drill bit may also be referred to as a rock bit or simply a bit, and the like. In examples, the drill bit 102 may be a fixed cutter bit or a hybrid bit that combines both rolling cutter elements and fixed cutter elements (cutters 104). In the illustrated example, only one cutter 104 of the multiple cutters is depicted for clarity.

The drill bit 102 may be a component of a drill string 106 or coupled to the drill string 106. The drill bit 102 may be lowered via the drill string 106 into the hole or wellbore 108 to drill the wellbore 108. The wellbore 108 as a hole in the ground may be formed through an Earth surface 110 into an Earth formation 112. In operation, a drilling fluid (also known as drilling mud) is circulated down the drill string 106 and through nozzles 113 provided in the drill bit 102 to the bottom of the wellbore 108. The drilling fluid may then flow upward toward the surface 110 through an annulus formed between the drill string 106 and the wall of the wellbore 108. The drilling fluid may cool the drill bit 102, apply hydrostatic pressure upon the formation penetrated by the wellbore 108 to prevent or reduce fluids from flowing into the wellbore 108, reduce torque and drag between the drill string 106 and the wellbore 108, carry the formation cuttings to the surface 110, and so forth. The drill bit 102 typically has more than one nozzle 113.

A drill string 106 on a drilling rig may be a column or string of drill pipe that transports drilling fluid pumped from mud pumps to the drill bit 102. In addition, the drill string 106 may transmit torque via a drive to the drill bit 102. In certain examples, the drill string 106 may be the assembled collection of drill pipe, drill collars, tools, and the drill bit 102, and the like.

A plurality of drill pipe couple end-to-end, such as via tool joints, may make up the majority of the drill string 106 to the surface 110. Each drill pipe may be a relatively long tubular section having a specified outside diameter or nominal diameter, such as 3½ inches, 4 inches, 5 inches, 5½ inches, 5⅞ inches, 6⅝ inches, and so forth.

In certain embodiments, the drill string 106 includes the drill pipe as well as a bottom hole assembly (BHA) and transition pipe which may be heavyweight drill pipe (HWDP). The BHA may include the drill bit 102, drill collars which may be relatively heavy tubes to apply weight to the drill bit 102, and drilling stabilizers which maintain the assembly centered in the hole. The BHA may also include a downhole motor and rotary steerable system, measurement while drilling (MWD) tools, and logging while drilling (LWD) tools, and the like. The components of the drill string 106 may be joined together via threaded connections or other connections.

The drill string 106 may be hollow so that drilling fluid can be pumped through the drill bit 102 and ejected through nozzles 113 of the drill bit 102. As mentioned, the drilling fluid may be circulated back up an annulus such as between the drill string and the open hole or casing. Most rolling cutter and fixed cutter drill bits have internal passages to direct drilling fluid through hydraulic nozzles 113 directed at the bottom of the wellbore 108 to produce high-velocity fluid jets. These jets may assist in cleaning rock cuttings off the bottom before the next contact of the drill bit 102 with the rock. Again, the drilling fluid may be conveyed to the drill bit 102 by the drill pipe from surface pumps. The circulating drilling fluid may provide buoyancy to the drill string 106, lubricate the drilling, cool equipment, remove cuttings from the wellbore 108, and so forth.

The drill site 100 typically has a drilling rig including equipment discussed above and includes surface equipment 114 such as tanks, pits, pumps, and piping for circulating drilling fluid (mud) through the wellbore 108. Settling equipment or a separation vessel, such as a shale shaker, may receive a slurry of the drilling fluid and rock cuttings from the wellbore 108. The shale shaker may separate rock cuttings from the drilling fluid. Pits may collect removed rock cuttings. The drilling rig or surface equipment 114 may include a derrick, Kelly drive, top drive, rotary table, drill floor, blowout preventer (BOP), and additional equipment, components, or features. A mobile laboratory onsite may test the drilling fluid or rock cuttings. Temporary housing may be provided at the drill site 100 for operating personnel, and the like.

In general, a drilling rig is a machine that creates holes in the Earth subsurface. The term "rig" may refer to equipment employed to penetrate the surface of the Earth's crust. Oil and natural gas drilling rigs create holes to identify geologic reservoirs and that allow for the extraction of oil or natural gas from those reservoirs.

The hole or wellbore 108 diameter produced by a drill bit 102 may be in a range from about 3.5 inches (8.9 centimeters) to 30 inches (76 centimeters), or outside of this range. The depth of the hole 108 can range from 1,000 feet (300 meters) to more than 30,000 feet (9,100 meters). Subsurface formations are broken apart mechanically by cutting elements 104 of the bit 102 by scraping, grinding, localized compressive fracturing, and so on. As indicated, the cuttings produced by the bit 102 are typically removed from the wellbore 108 and returned to the surface 110, for example, via direct circulation. The return may be continuous, substantially continuous, or intermittent.

Drill bit performance may be based on at least rate of penetration (ROP) and service life of the drill bit. The ability of a bit design to advance these goals may be constrained by a number of factors such as wellbore diameter. Other constraints include those dictated by the application, such as formation type or operating environment at depth, and whether the angle of the wellbore is vertical, directional, or horizontal. Formation type considerations may include hardness, plasticity, and abrasiveness. Operating environment constraints may include temperature, pressure, and corrosiveness. Additional factors may include capabilities of the equipment in operation such as with respect to rotating speed, available weight on bit, pump horsepower, and so on.

Again, performance of drill bits such as in rotary drilling may be correlated with ROP into the formation and service life of the drill bit. Modern oilfield drilling operations spend capital and operating expense to mobilize equipment and manpower resources for drilling to the site. Once the rig is in place, daily expenses may be incurred regardless of whether the wellbore is actually being drilled. The faster the wellbore reaches desired total depth, generally the lower the overall cost. When the bit fails or wears out, the drill bit is commonly replaced by removing the drill pipe to which the drill pipe is attached. In examples, the drill pipe can be up to several miles in length. During this time of raising and lowering the drill pipe, known as a "trip," the depth of the hole is not advanced but much of the operating costs may still be incurred. For at least this reason, the effectiveness of a bit is often measured as drilling cost per length (foot, meter) of hole drilled, where a lower number indicates a higher performing bit. An extended bit life typically results in less trips and thus gives shorter time to drill the hole. A shorter time can save significant operating expenses of the drilling. Note that the cost of the bit itself often is a rather small part of the overall drilling cost. Embodiments herein of cutters for drill bits may increase ROP and extend bit life, and therefore improve drilling economics.

Figure 2:
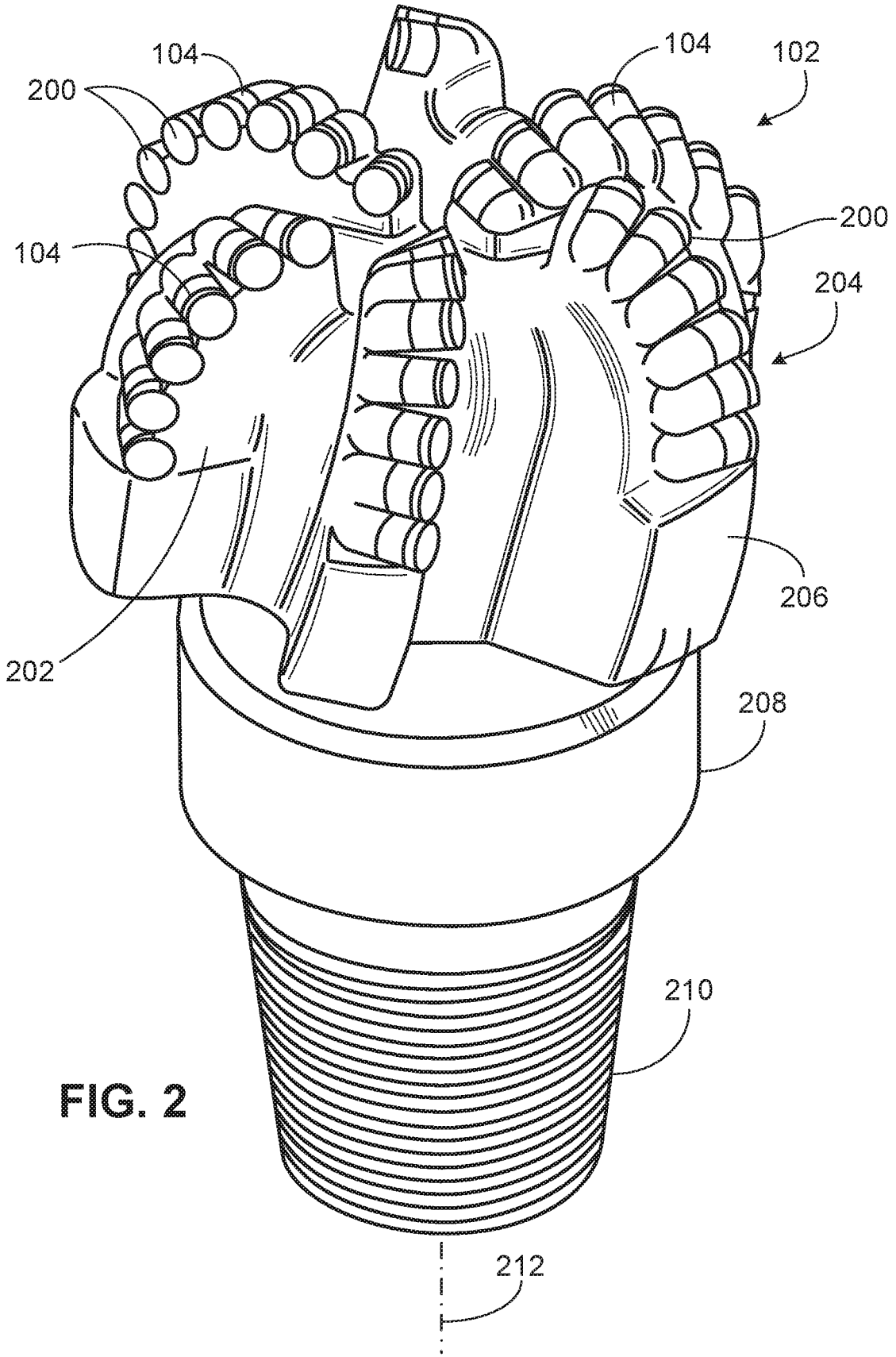
FIG. 2 is a perspective view of a rotary drill bit.

FIG. 2 is a drill bit 102 as fixed cutter bit having cutters 104 for drilling through formation of rock to form a borehole or wellbore. The cutters 104 each have a cutting table with a cutting face 200. The bit 102 may be a PDC bit and the cutters 104 may be PDC cutters. The cutters 104 may be installed in or inserted into seats or blades 202 on the face 204 of the drill bit 102. In some implementations, the cutters 104 may be coupled to the blades 202 by brazing.

The outermost surface 206 may define the nominal or labeled diameter of the bit 102 to establish bit size. The drill bit 102 generally has a main body 208 and a pin or threaded connection 210 to couple the drill bit 102 to the drill pipe or drill string 106. (See FIG. 1.) The central axis of the drill bit 102 is denoted by reference numeral 212. The drill bit 102 typically includes nozzles, such as nozzles 113 of FIG. 1, for ejecting drilling fluid or drilling mud. Lastly, the drill bit as a PDC bit may be matrix-body bit, steel-body bit, and the like.

As discussed, a drill bit cuts into the rock when drilling an oil or gas well. Located at the tip or end of the drill string, below the drill collar and the drill pipe, the drill bit is a rotating apparatus having cones, blades, or cutters made up of the hardest of materials (for example, steel, tungsten carbide, synthetic or natural diamonds) and in some instances, having sharp teeth that cut into the rock and sediment below. Rotary drilling employs a rotating drill bit to grind, cut, scrape and crush the rock at the bottom of the well. Rotary drilling generally includes at least the drill bit, drill collar, drilling fluid, rotating equipment, and hoisting apparatus. The hoisting equipment handles lifting the drill pipe to insert drill pipe into the well or lift drill pipe out of the well.

Additionally, as indicated, drill bits are changed due to wear and tear. When a drill bit is changed, the drill pipe (for example, in 30-feet increments) is hoisted out of the well, until the complete drill string has been removed from the well. Once the drill bit has been changed, the complete drill string is again lowered into the well.

As discussed, PDC bits use cutters that are synthetic diamonds attached to, for example, carbide inserts. Diamond cutters may be 40 to 50 times stronger than steel cutters. Further, hybrid drill bits may address specific drilling applications.

Figure 3:
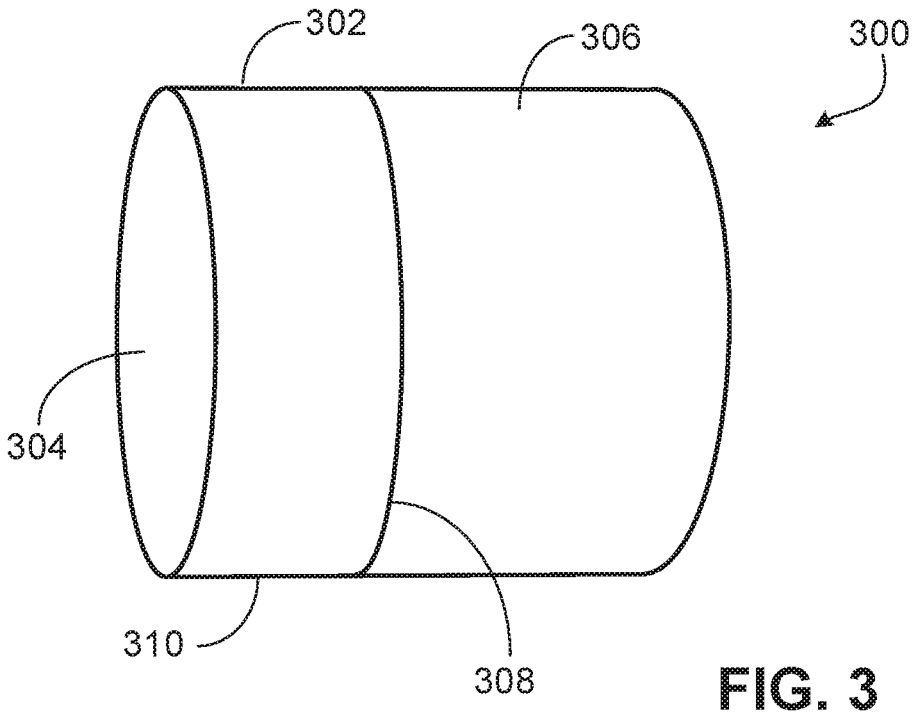
FIG. 3 is a perspective view of a cutter for a drill bit.

FIG. 3 is a cutter 300 for a drill bit. The cylindrical cutter 300 includes a cylindrical cutting table 302 having a top surface as a circular cutting face 304. The cutting table 302 is coupled or bonded to a cylindrical substrate 306 at an interface 308. For example, the bottom surface of the cutting table 302 may be sintered to the top surface of the substrate 306.

The diameter and circumference of the cutting surface 304 are the same as the diameter and circumference of the top surface of the substrate 306. The side perimeter 310 of the cutting table 302 is generally in-line with the side perimeter of the underlying substrate 306. In other words, the side perimeter 310 in a longitudinal direction may be generally parallel with the longitudinal central axis of the cutter 300.

The cutter 300 may be a PDC cutter for a PDC drill bit or hybrid drill bit. The cutter 300 and its substrate 306 may fit into typical seats or conventional blades of fixed-cutter bits. In some examples, the cutting table 302 may be or include PCD material.

Figure 4:
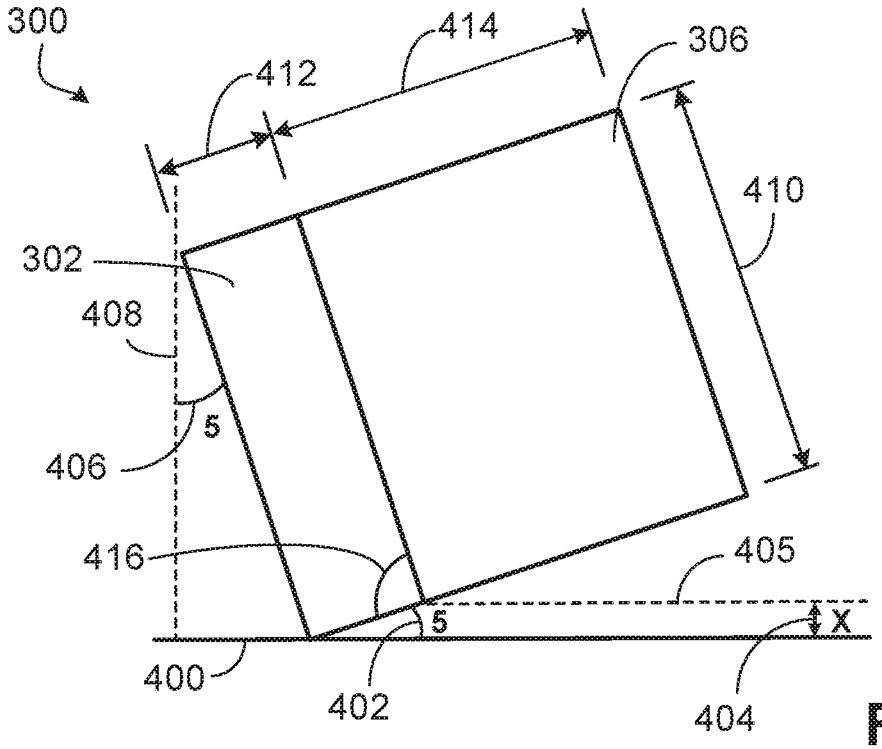
FIG. 4 is a side view of the cutter of FIG. 3 disposed adjacent a surface being drilled.

FIG. 4 is the cutter 300 depicted at a drilling interface with a surface 400 of a formation downhole. The drill bit in which the cutter 300 is installed is not shown for clarity. The Bakr angle 402 is defined herein as the angle between the surface 400 of the formation being drilled and a line of the side perimeter 310 of the cutting table 302 closest to the surface 400. In general, the Bakr angle 402 may be the angle between the cutter 300 body and the downhole formation. The bounds of the Bakr angle 402 may be 0 degrees and 90 degrees. In other words, the Bakr angle 402 is generally an acute angle. Indeed, for a Bakr angle less than 0 degrees or greater than 90 degrees, the cutter 300 cutting edge may not touch the formation or surface 400 and thus not drill. An example range for the Bakr angle 402 is 5 degrees to 15 degrees. The elevation 404 is the perpendicular distance (X) between the surface 400 and the line 405, which is the shortest elevation of the top surface of the substrate 306 above the surface 400.

Further, in the drilling operation, the cutter 300 has a back rake angle 406. The back rake angle 406 is the angle between the cutting face 304 and a line 408 perpendicular to the surface 400 of the formation being drilled. Generally, as the back rake angle 406 decreases, the cutting efficiency increases (high ROP) but the cutter 300 becomes may be more vulnerable to impact breakage. Increasing the back rake angle 406 may give a lower ROP but a longer bit life.

In FIG. 4, the Bakr angle 402 has the same value as the back rake angle 406. In an example, the Bakr angle 402 is 5 degrees and the back rake angle 406 is 5 degrees. The length of the cylindrical cutting table 302 is indicated by reference numeral 412. The length of the cylindrical substrate 306 is indicated by reference numeral 414. The cutting table 302 and the substrate 306 are both generally solid.

Figure 5:
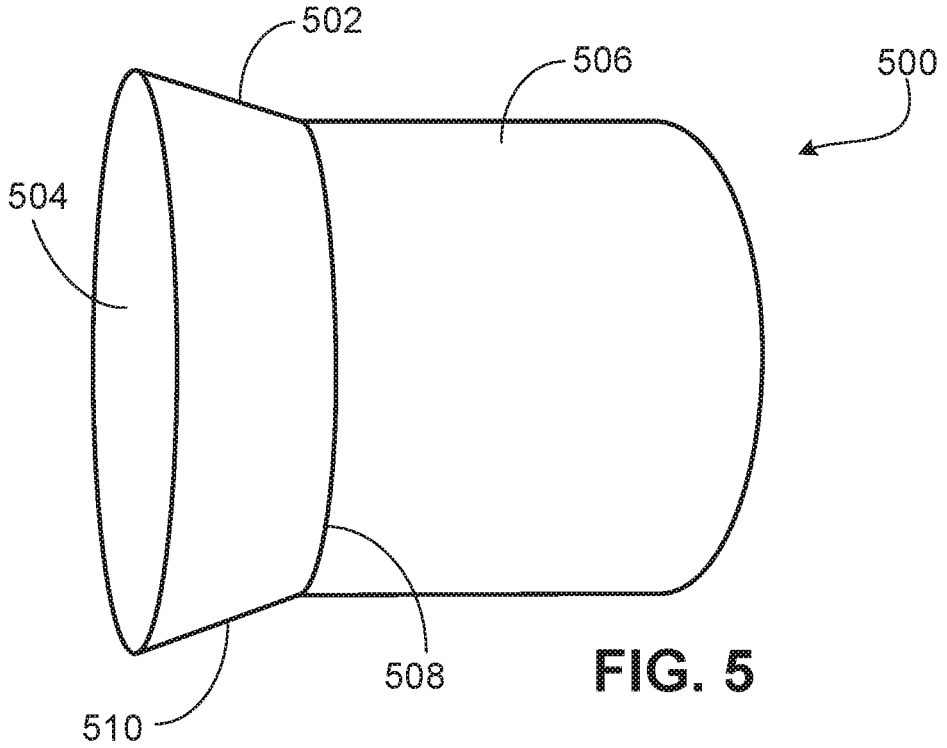
FIG. 5 is a perspective view of a cutter for a drill bit.

The cutting table 302, cutting surface 304, and substrate 306 all have the same diameter 410 and thus have the same radius. For the illustrated cutter 300, the cutting table 302 and the substrate 306 are both right cylinders. The angle 416 between the top surface of the substrate 306 and the side perimeter 310 of the cutting table 302 is a right angle or 90 degrees. In other words, the interior angle 416 between the bottom surface of the cutting table 302 and the side perimeter 310 is a right angle or 90 degrees. Some cutter 300 designs may employ an angle 416 of less than 90 degrees. On the other hand, an innovative design, as discussed below with the examples of FIG. 5, provides an angle 416 that is an obtuse angle (more than 90 degrees but less than 180 degrees). In general, the specified or applied range of the interior angle 416 may be identified based on the manufacturer engineering design, the drilled formation, cutter 300 material, borehole size, cost, and so on.

Lastly, the interior angle between the cutting surface 304 and the side perimeter 310 is a right angle or 90 degrees. This angle can be related to the sharpness of the cutting edge of the cutter 300.

FIG. 5 is a cutter 500 for a drill bit. The cutter 500 includes a cutting table 502 having a top surface as a circular cutting face 504. The cutting table 502 may be labeled as a diamond table in embodiments of the cutting table 502 including diamond or diamond materials. The cutting table 502 is coupled or bonded to a cylindrical substrate 506 at an interface 508. For example, the bottom surface of the cutting table 502 may be sintered to the top surface of the substrate 506. In some examples, the interface 508 is a nonplanar interface between the substrate 506 and the cutting table 502 or diamond table that creates a bond when the cutting table 502 is sintered to the substrate 506.

The substrate 506 may be a solid right cylinder. The substrate 506 and its top surface are smaller in circumference than the cutting face 504. Indeed the cutting table 502 increases in diameter along a direction away from the substrate 506. Thus, the side perimeter 510 will have increase surface area compared to the side perimeter 310 of the cutting table 302 of FIG. 3. The increased surface area may promote additional cooling of the cutting table 502.

The cutting table 502 may be solid but is not a right cylinder. While the side perimeter 510 and the side perimeter side of the substrate 506 meet at the interface 508, the side perimeter 510 of the cutting table 502 is not generally in-line with the side perimeter of the underlying substrate 506. As indicated, the circumference of the cutting surface 504 is larger than the circumference of the top surface of the substrate 506.

The shape of the cutting table 502 may be described as the following examples: (a) a truncated right circular cone inverted with respect to the substrate 506; (b) a conical frustum inverted with respect to the substrate 506; (c) a conical frustum that tapers toward the substrate 506; and (d) a conical frustum having a slant height that slopes outward from a central axis of the cutting table 502 along the direction away from the substrate 506. In a particular example, the cutting table 502 is a truncated right circular cone having a smaller base and a larger base. The smaller base is coupled to the substrate 506. The larger base is the cutting face 504.

The cutting table 502 may be a superhard material having a Vickers hardness of at least 40 GPa or at least 70 GPa, and the like. The Vickers hardness test observes ability of a material to resist plastic deformation from a standard source. While the hardness number can be given in units of pascals this hardness value is not pressure. The hardness number or value may be determined by the load over the surface area of the indentation and not the area normal to the force, and is therefore not pressure.

In some examples, the cutting table 502 is PCD material or PDC material, and the cutter 500 is a PDC cutter for a PDC drill bit or hybrid drill bit. PCD generally has fracture toughness and thermal stability, and may form geological drill bits. PDC material may be made by combining layers of PCD with a layer of cemented carbide liner. PDC may have advantages of diamond wear resistance with carbide toughness.

Figure 6:
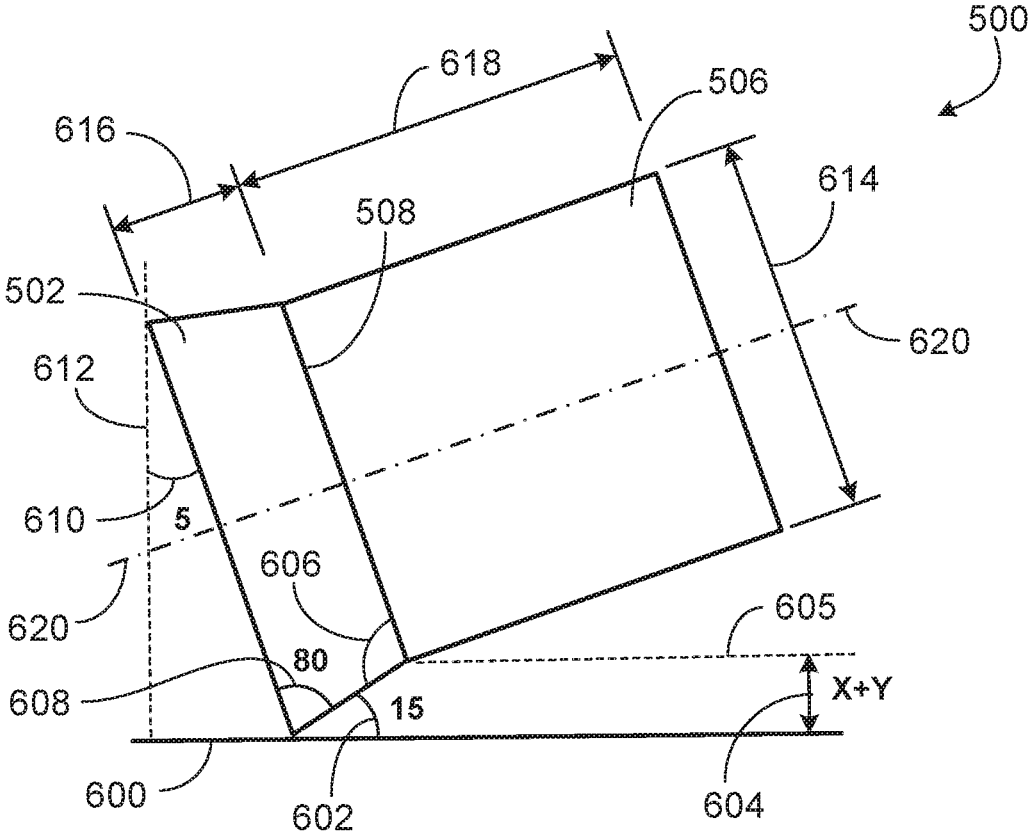
FIG. 6 is a side view of the cutter of FIG. 5 disposed adjacent a surface being drilled.

FIG. 6 is the cutter 500 depicted at a drilling interface with a surface 600 of a formation downhole. The drill bit in which the cutter 500 is installed is not shown for clarity. Again, the Bakr angle 602 is defined herein as the angle between the surface 600 of the formation being drilled and a longitudinal line of the side perimeter 510 (of the cutting table 502) closest to the surface 600.

The elevation 604 is the perpendicular distance (X+Y) between the surface 600 and the line 605, which is the shortest elevation of the top surface of the substrate 506 above the surface 600. The flaring or sloping outward of the cutting table 502 along a direction away from the substrate 506 increases the elevation 604 of the substrate 606 above the surface 600, as compared to the elevation 404 (X) of FIG. 4.

The angle 606 between the top surface of the substrate 506 and the side perimeter 510 of the cutting table 502 is not a right angle but is obtuse or greater than 90 degrees. In other words, the interior angle 606 between the bottom surface of the cutting table 502 and the side perimeter 510 is obtuse. Thus, the interior angle 608 between the cutting surface 504 and the side perimeter 510 is an acute angle or less than 90 degrees. The angle 608 can be related to the sharpness or thickness of the cutting edge of the cutter 500.

In the drilling operation, the cutter 500 has a back rake angle 610. Again, the back rake angle 610 is the angle between the cutting face 504 and a line 612 perpendicular to the surface 600 of the formation being drilled. The back rake angle 610 may contribute to how aggressively the cutter 500 engages the rock surface 600.

The back rake angle 610 may be a different value than the Bakr angle 602. In the illustrated embodiment, the Bakr angle 602 has a greater value than the back rake angle 610. In an example, the Bakr angle 602 is 15 degrees and the back rake angle 610 is 5 degrees. Of course, other values for the angles 602 and 610 may be selected or specified and may vary based on, for example, the targeted formation to drill. As indicated, an increased Bakr angle 602 or the Bakr angle 602 being greater than the back rake angle 610 may promote elevation of the substrate 506 above the surface 600 of the formation being drilled.

The cutting surface 504 has a larger diameter than the diameter 614 of the substrate 506. This flared shape of the cutting table 502 and the greater Bakr angle 602 may provide for a pointier or sharper cutting edge to facilitate digging of the formation. In other words, the cutting edge angle is thinner or sharper than other designs even when the cutters are worn and thus benefits ROP. Indeed, the cutting edge having a smaller internal angle 608 may cut relatively easier with less effort. In examples, the cutting edge may be characterized by the size (degrees) of the internal angle 608 of the cutting edge. In some examples, this internal angle 608 may be labeled as the cutting angle 608.

In some examples, the Bakr angle 602 or increase in the Bakr angle 602 with respect to a back rake angle 610 held constant may be related to or a function of (correlated with) strength, toughness, or hardness of the cutting table 502 material. Properties such as strength, toughness, and hardness may be related and share units such as MPa or GPa. Even with the cutting table 502 material including diamond, a strength constraint such as toughness or tensile strength of the cutting table 502 may correlate with an upper value for the Bakr angle 602. In certain implementations, an upper value (for example, +50 degrees) for the positive difference of the Bakr angle 602 compared to the back rake angle 610 is specified. Otherwise, in examples, the cutting table 502 (for instance, a diamond table) may be too thin and thus susceptible to breaking. In some examples, the Bakr angle may be based at least in part on the diamond grade in the cutting table 502 of the cutter 500.

The length of the cutting table 502 is indicated by reference numeral 616. The length of the cylindrical substrate 506 is indicated by reference numeral 618. Further, in the illustrated embodiment, the cutting table 502 and the substrate 506 share the same central axis 620.

As indicated, the back rake angle 610 is the angle between the cutting face 504 and a line 612 perpendicular to the surface 600 of the formation being drilled. As also discussed, the Bakr angle 602 is defined herein as the angle between the surface 600 of the formation being drilled and a longitudinal line of the side perimeter 510 (of the cutting table 502) closest to the surface 600. For cases when this longitudinal line is not parallel to the central axis 620, the Bakr angle 602 value may be different than the back rake angle 610 value.

Conversely, for the case when this longitudinal line is parallel to the longitudinal central axis (as in FIGS. 3 and 4), the Bakr angle 402 and the back rake angle 406 may be equal in value, as indicated in FIGS. 3 and 4. Indeed, in that particular case, some may label the Bakr angle 402 as the back rake angle and call both angles 402 and 406 the back rake angle. After all, the angles 402 and 406 as depicted are generally equal in value. However, the present disclosure defines the Bakr angle 402, 602 as having a different definition than the back rake angle 406, 610, as noted above.

Figure 7:
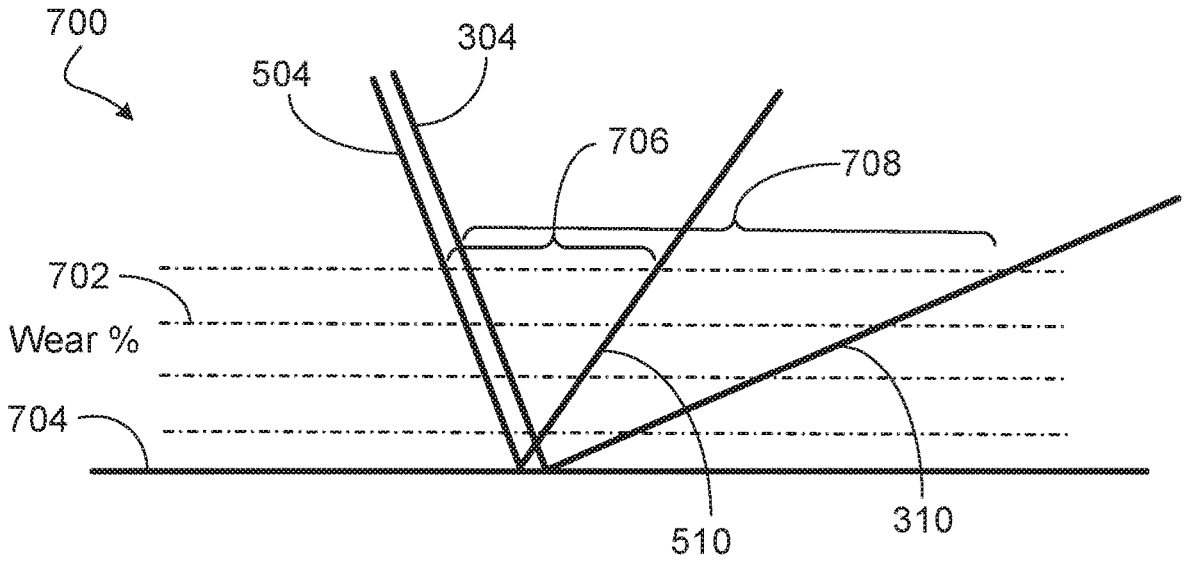
FIG. 7 is a graphical representation of bit cutter wear percent.

FIG. 7 is a graphical representation 700 of bit cutter wear % 702 and the surface 704 of formation being drilled. The dashed lines from bottom to top may be 25%, 50%, 75%, and 100% of wear experienced by a cutting table of the bit cutter. A wear percent 702 of 100% may mean that the wear has reached to the substrate underlying the cutting table.

The representation 700 may indicated a correlation of bit geometry with wear % 702. The cutting face 304 and side perimeter 310 of the cutting table 302 of FIG. 3 are depicted. The cutting face 504 and side perimeter 510 of the cutting table 502 are also depicted. The geometry of the cutting table 502 may give a sharper cutting edge and deliver increased cutting ability compared to the cutting table 302. In examples, the cutting table 302 and the cutting table 502 may be diamond tables.

Bracket 706 points to the portion of the cutting table 502 that will be touching the formation while drilling over the wear percent of the cutting table 502. Initially at 0% or no wear, the cutting table 502 has a cutting face 504 with a thin or pointed cutting edge against the surface 704. During drilling, the cutting edge will become worn. The wear results in a cutting edge with more surface area (a face) instead of a pointed edge against the surface 704. Thus, for the cutting table 502/cutting face 504, a second smaller face abutting the formation surface 704 and having a surface area will evolve from the thinner cutting edge over time as the cutting table 502 wears.

Likewise, bracket 708 points to the portion of cutting table 302 that will be touching the formation (surface 704) while drilling over the wear percent of the cutting table 302. The cutting edge of the cutting table 302 will wear giving more surface area (a face instead of a pointed edge) of the cutting table 302 against the surface 704. Thus, for the cutting table 302/cutting face 304 a second smaller face abutting the formation surface 704 and having a surface area will evolve from the thinner cutting edge over time as the cutting table 302 wears.

As indicated in FIG. 7, over the range of wear percent 702, the cutting edge or cutting surface area of the cutting table 502 against the surface 704 will be sharper or thinner (less surface area) than the cutting edge or cutting surface area of the cutting table 302 against the 704. For example, at 50% wear, the representation 700 depicts the width of the cutting edge of the cutting table 302 as more than twice as great as the width of the cutting edge of the cutting table 502. Again, in the comparison over the wear of the cutting tables 302, 504, the cutting edge of the cutting table 502 will be thinner or sharper and less blunt than the cutting edge of the cutting table 302. While the cutting edge of both cutting tables 302, 502 will become less sharp over time during drilling due to wear, the cutting edge of the cutting table 502 will be sharper than that of the cutting table 302, generally leading to more efficient drilling in terms of ROP and total drilled footage.

Lastly, the cutting face 304 and the cutting face 504 may be defined as the cutting surface of the cutting table 302 and cutting table 502, respectively. However, the cutting edge may be a portion of the cutting table 302, 502 and formed at an intersection of the cutting face 304, 504 and the side 310, 510. The cutting edge as worn against the formation surface 704 in operation may include a cutting surface area of the cutting table 302, 502 that develops in direct contact with the formation surface 704.

Figure 8:
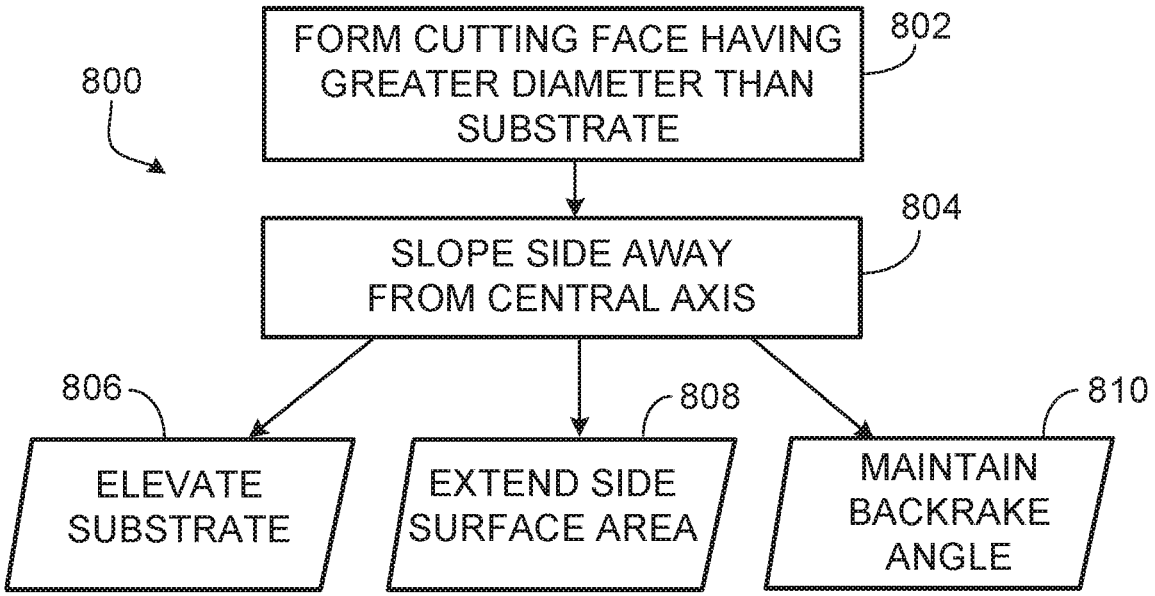
FIG. 8 is a block flow diagram of a method of fabricating a drill bit cutter.

FIG. 8 is a method 800 of fabricating a drill bit cutter. At block 802, the cutting face of the cutting table for the cutter is formed having a greater diameter than the substrate of the cutter. For instance, the cutter may have the geometry of the example cutter 502 of FIG. 5. Indeed, at block 804, the cutter may be fabricated such that the side of cutting table slopes away from a central axis along a direction away from the cylindrical substrate. In fact, in examples, the cutting table increases in width or diameter along a direction away from the substrate. Thus, the cutting table may have a top surface or cutting face greater in width or diameter than the substrate including the support surface of the substrate. The aforementioned direction can be along a central axis of the cutting table and of the substrate.

The shape of the cutting table may be a truncated right circular cone inverted with respect to the substrate or a conical frustum inverted with respect to the substrate. The cutting table may be a conical frustum that tapers toward the substrate or a conical frustum having a slant height that slopes outward from a central axis of the cutting table along the direction away from the substrate. Therefore, as discussed, the geometry may promote elevation 806 of the cutter substrate above the formation surface being drilled. The geometry may also extend 808 the side surface area of the cutting table, which can promote ambient cooling of the cutting table. The geometry can provide maintaining 810 a back rake angle while implement a greater Bakr angle, as also discussed above. In examples, such may extend life of the cutter or increase ROP of the drill bit into the wellbore.

Figure 8A:
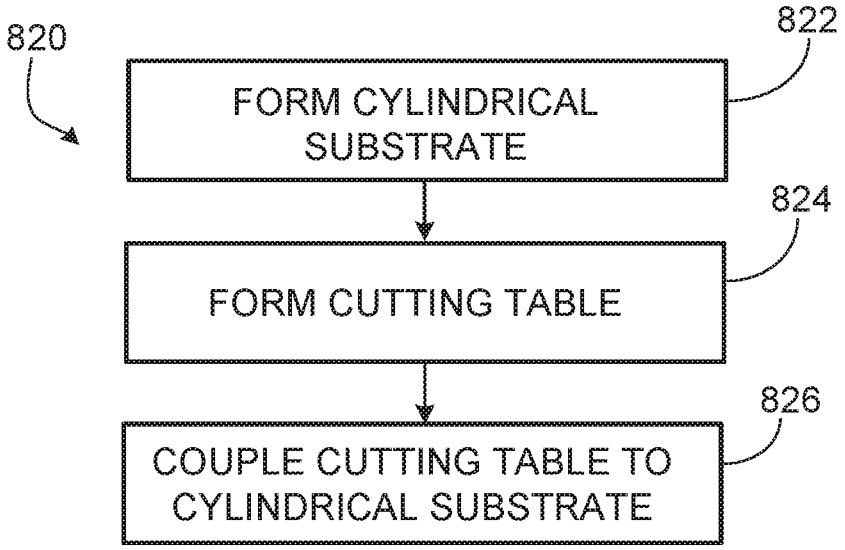
FIG. 8A is a block flow diagram of a method manufacturing a drill bit cutter.

FIG. 8A is a method 820 of manufacturing a cutter, such as a PDC cutter, for a drill bit. A PDC cutter may be made up of a cylindrical or wafer diamond table as a cutting table, and a cylindrical tungsten carbide substrate. A die or mold may form the cutting table to a desired shape.

At block 822, a substrate is received or formed. In certain examples, powdered material is pressed or molded into shape to form the substrate. The substrate may be a cylindrical substrate. In some examples, the substrate may be a solid right cylinder or sized to fit in seats or blades on a typical rotary bit. The substrate may be or include metal such as steel.

The substrate may be or include tungsten carbide. In examples, tungsten carbide in powdered form is pressed in a mold to a desired shape. The substrate material (including tungsten carbide) may be labeled as a metal, ceramic-metallic or cermet, or a composite material with tungsten carbide embedded in a matrix of metallic cobalt. In pure form, tungsten carbide may be characterized as a ceramic material. Yet with the addition, for example, of 6 weight % to 10 weight % cobalt, the mixture may behave as a metal and be labeled a ceramic-metal.

At block 824, the method includes receiving or forming a cutting table or diamond table. The cutting table or diamond table is generally the part of a cutter that contacts a formation during drilling. In manufacture, forming the cutting table as a PDC table into a desired shape such as a conical frustum may involve placing diamond grit together with an underlying substrate in a pressure vessel and then sintering under heat and pressure. However, other manufacturing techniques are applicable.

In some implementations, the cutting table may be a solid form produced by pressing or compacting a powder (for example, a finely ground powder) inside a die, press, or hot press. In addition to pressure, heat is applied to transform the powder to a continuous solid. A blend of fine metallic or ceramic powder is placed in a die and compressed under pressure. The compressed particles fuse (sinter) together as heat is applied. Partial melting may give diffusion of atoms between granules, reduction of porosity, and increase in density. The powder granules adhere and form a solid when cooled. To manufacture a diamond table, diamond grit may be sintered with tungsten carbide and metallic binder to form a diamond-rich layer. Diamond grit may be formed by heating carbon.

The cutting table may be PCD material or PDC material. The PCD material may be made by sintering micro-size single diamond crystals at a specified temperature and pressure. PDC material may be made by combining layers of PCD with a layer of cemented carbide liner at relatively high temperature and pressure. Diamond grit may be tiny grains (for example, about 0.00004 inch in diameter) of synthetic diamond as a raw material for PDC cutters.

The cutting table may be formed, compacted, or sintered such as in a press or mold to have a changing or sloping diameter. Thus, the cutting table may have a top surface greater in diameter than its bottom surface. Again, the shape of the cutting table may be a truncated right circular cone or a conical frustum. The die or hot press may receive the diamond powder or base material into a compartment or mold having the desired shape of the cutting table.

Again, for a PDC bit, the compact may be a disk made of PCD synthesized by sintering diamond grit with a catalyst under pressure and temperature. During manufacturing, the diamond grit may be fused with cobalt under heat and pressure to produce a cylinder, wafer, or other shape of PCD. As mentioned, the cutter may have the two parts of a PCD table and a substrate. The table is the part that contacts the formation. Table thickness ranges may be in a range of 2 millimeters (mm) to 4 millimeters, or outside that range.

At block 826, the method includes coupling the cutting table to the substrate. The cutting table or diamond table may be sintered to the substrate which can be composed of tungsten carbide. In some examples, a nonplanar interface between the substrate and the diamond table may create a bond between the two when the diamond table is sintered to the substrate. Lastly, in certain implementations, the actions of blocks 824 and 826 may be performed together or contemporaneously including in the hot press or die. In other words, the substrate may be placed in the equipment, and the formation of the cutting table and the binding of the cutting table to the substrate implemented together.

Figure 9:
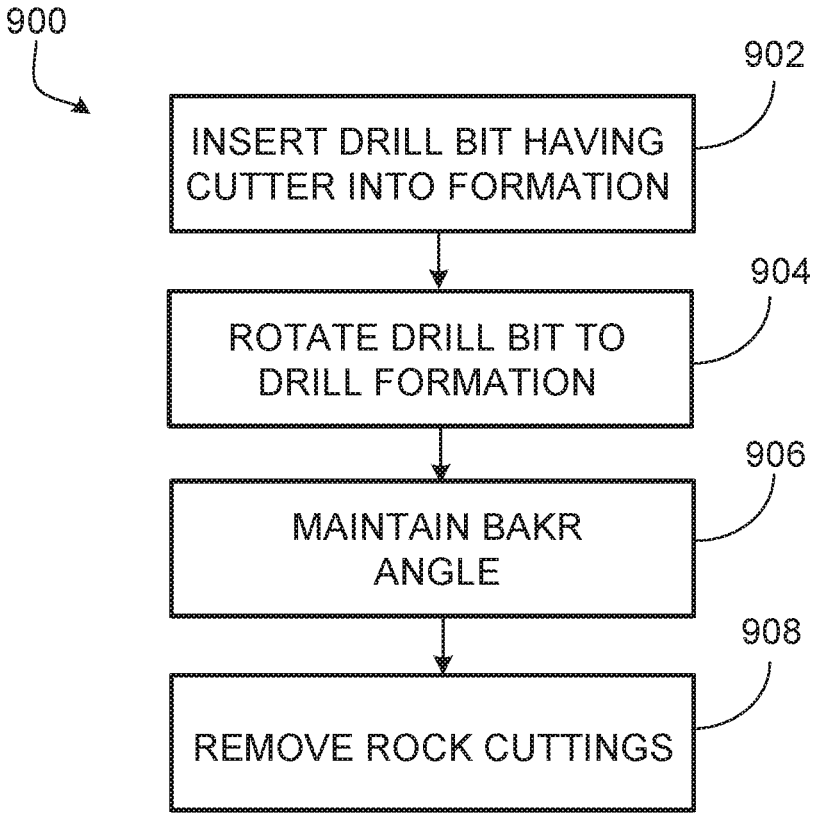
FIG. 9 is a block flow diagram of a method of drilling a hole in a formation.

FIG. 9 is a method 900 of operating a drill bit having a cutter to drill a hole in a formation. The drill bit typically has multiple cutters. The drill bit may be a polycrystalline compact (PDC) drill bit and the cutter a PDC cutter. The cutter includes a cutting table coupled to a cylindrical substrate, wherein the cutting table includes polycrystalline diamond (PCD). The cutting table increases in diameter along a direction away from the cylindrical substrate. Thus, the cutting table has a cutting face greater in diameter than the diameter of the cylindrical substrate. Indeed, the cutting table may have a shape of a conical frustum that tapers toward the cylindrical substrate. In other words, the cutting table may have a shape of a conical frustum inverted with respect to the substrate.

At block 902, the method includes lowering or inserting the drill bit having the cutter into the formation such as into a hole or wellbore being drilled. A drilling rig or drill string may facilitate lowering of the drill bit into the wellbore. Indeed, the drill bit may couple to or be a component of the drill string at the tip or end of the drill string.

At block 904, the method includes rotating the drill bit to drill the hole into the formation. The drill bit may perform to give a resulting ROP. Typically, the drill bit experiences wear that affects or reduces the life of the drill bit.

At block 906, the method includes maintaining a Bakr angle of the cutter with respect to a surface of the formation greater than a back rake angle of the cutter with respect to the surface. Such may promote ROP of the drill bit and thus reduce cost of the drilling operation. In certain examples, the back rake angle may be maintained at less than 12 degrees and with the Bakr angle maintained at 13 degrees or greater.

Lastly, at block 908, the method includes removing rock cuttings from the formation. For example, drilling fluid circulating through nozzles of the drill bit may remove or displace formation rock cuttings from the wellbore. At the surface, the rock cuttings may be separated from the drilling fluid, and the drilling fluid recirculated to the wellbore and drill bit.

In summary, an embodiment includes a drill bit for drilling into a formation, the drill bit having a plurality of cutters. Each cutter has a substrate with a support surface, and a cutting table including PCD and coupled to the support surface. A side of the cutting table along a direction opposite the substrate slopes outward such that a cutting face of the cutting table is greater in diameter than the support surface. The cutting table and the substrate may share a central axis. The side sloping outward may involve the side sloping outward away from the central axis. In some implementations, the cutting table has a shape of a conical frustum that tapers toward the substrate. In other words, the shape is a conical frustum inverted with respect to the substrate.

The shape of the cutting table may be a frustum of a right circular cone, wherein the smaller base of the frustum is coupled to support surface and the larger base of frustum larger is the cutting face or cutting surface and is larger in diameter than substrate. In some implementations, the diameter of the smaller base may be equal to diameter of the support surface. Thus, the radius of the substrate and support surface is less than the radius of the larger base of the cutting table and equal to the radius of the smaller base of the cutting table.

The substrate may be a cylindrical substrate such as a solid right cylinder. The substrate may be a cylindrical substrate having a top surface, a bottom surface, and a side surface extending from the top surface to the bottom surface, wherein circumference of the top surface is equal to circumference of the bottom surface, and wherein the support surface is the top surface.

Another embodiment is a cutter for a drill bit to drill a formation. The cutter has a cylindrical substrate (for example, a solid right cylinder), and a cutting table that is superhard material (for example, diamond or PCD) coupled to the substrate. The superhard material may have a Vickers hardness of at least 40 GPa or at least 70 GPa. The cutter may be a PDC cutter and the drill bit may be a PDC drill bit. The cutting table along a direction away from the cylindrical substrate increases in width or diameter. In certain examples, the direction is along a central axis of the cutting table and of the cylindrical substrate. Thus, the cutting table may have a cutting face having a width or diameter greater than width or diameter of the cylindrical substrate. The increasing width or diameter may facilitate a specified value of a Bakr angle between the cutter and a surface of the formation during drilling, or also facilitate a specified elevation of the cylindrical substrate above the surface of the formation. In examples, an angle between a top surface of the substrate and a side of the cutting table is obtuse. An angle between the cutting face and a side of the cutting table is an acute angle. The cutter may be for the drill bit to drill a wellbore in the formation, and wherein the cutting table increasing in width to maintain a Bakr angle of the cutting table with respect to a surface of the formation. The cutting face greater in diameter than the cylindrical substrate may provide for or facilitate a specified value of a Bakr angle of the cutter with respect to a surface of the formation during drilling and for a specified amount of elevation of the cylindrical substrate above the surface during drilling.

The cutting table may have a bottom surface and the cylindrical substrate has a support surface, wherein the cutting table coupled to the cylindrical substrate includes the bottom surface coupled (for example, sintered) to the support surface. The diameter of a cutting face of the cutting table may be greater than diameter of the support surface. The support surface may be a top surface of the cylindrical substrate.

In some examples, the cutting table has a shape of a conical frustum that tapers toward the cylindrical substrate. The cutting table may have a shape of a conical frustum inverted with respect to the cylindrical substrate, and wherein the cutting table has a cutting face greater in diameter than the support surface and the cylindrical cylinder. The cutting table may be a conical frustum having a slant height that slopes outward from a central axis of the cutting table along the direction away from the cylindrical substrate. Such may be to maintain a Bakr angle between the cutter and a surface of the formation during drilling. The cutting table may be a shape of a truncated right circular cone inverted with respect to the substrate. The cutting table may have a shape of a truncated right circular cone having a first base and a second base larger in diameter than the first base, the first base coupled to the cylindrical substrate, and the second base as a cutting face larger in diameter than diameter of the cylindrical substrate.

Yet another embodiment is a method of manufacturing a polycrystalline diamond compact (PDC) cutter for a drill bit, the PCD cutter including a cutting table and a cylindrical substrate. The method includes forming or receiving the cylindrical substrate (for example, as a right solid cylinder) and forming or receiving the cutting table. The method includes coupling the cutting table to the cylindrical substrate. The cylindrical substrate may provide a circular support surface, wherein coupling includes sintering the cutting table to the circular support surface. The cutting table increases in diameter in a direction away from the cylindrical substrate. Therefore, the cutting face of the cutting table may be greater in diameter than the cylindrical substrate. The direction away from the cylindrical substrate may be along a central axis of the cutting table and of the cylindrical substrate. The cutting table may be a conical frustum that slopes outward from the central axis along the direction. In other words, the cutting table may have a shape of a conical frustum that tapers toward the cylindrical substrate. The sintering may include sintering a smaller base of the conical frustum to the circular support surface.

A number of implementations have been described. Nevertheless, it will be understood that various modifications may be made without departing from the spirit and scope of the disclosure.

What is claimed is:

1. A cutter for a drill bit to drill a formation, comprising:

a cylindrical substrate, wherein a top surface of the cylindrical substrate is equal in diameter to a bottom surface of the cylindrical substrate; and a cutting table comprising a superhard material and coupled to the top surface of the cylindrical substrate, wherein the cutting table along a direction away from the cylindrical substrate increases in width and is a shape of a conical frustum from the top surface of the cylindrical substrate to a cutting face of the cutting table.

2. The cutter of claim 1, wherein the drill bit comprises a polycrystalline diamond compact (PDC) drill bit that is a fixed cutter bit and the cutter comprises a PDC cutter that is a fixed cutter element for the fixed cutter bit, wherein the superhard material comprises polycrystalline diamond (PCD), wherein the cutting table comprises a cutting face having a width greater than width of the cylindrical substrate, and wherein the conical frustum is a frustum of a right circular cone.

3. The cutter of claim 1, wherein the direction is along a central axis of the cutting table and of the cylindrical substrate, wherein an angle between the top surface of the cylindrical substrate and a side of the cutting table is obtuse, wherein the cylindrical substrate is a right solid cylinder, wherein the conical frustum is a right circular conic frustum, and wherein the superhard material comprises diamond.

4. The cutter of claim 1, wherein the width comprises diameter, wherein the cutting table increases in diameter along the direction away from the cylindrical substrate, wherein the cylindrical substrate is a solid right circular cylinder, and wherein the superhard material comprises a Vickers hardness of at least 40 gigapascals (GPa).

5. The cutter of claim 1, wherein the increasing width to facilitate a specified value of a Bakr angle between the cutter and a surface of the formation during drilling, and wherein the increasing width to facilitate a specified elevation of the cylindrical substrate above the surface of the formation.

6. The cutter of claim 1, wherein the conical frustum comprises a straight side that tapers toward the cylindrical substrate, wherein the drill bit is a fixed cutter bit and the cutter is a fixed cutter for the drill bit, wherein in operation the cutter does not move relative to the drill bit, wherein the cylindrical substrate is a solid right circular cylinder, wherein the top surface is an upper base of the solid right circular cylinder and the bottom surface is a lower base of the solid right circular cylinder, and wherein coupled comprises the top surface coupled to a bottom surface of the cutting table.

7. The cutter of claim 1, wherein the conical frustum inverted with respect to the cylindrical substrate, and wherein the cutting face greater in diameter than the top surface of the cylindrical substrate.

8. The cutter of claim 1, wherein the conical frustum having a slant height that slopes outward from a central axis of the cutting table along the direction away from the cylindrical substrate to maintain a Bakr angle between the cutter and a surface of the formation during drilling, wherein the cylindrical substrate is a solid right circular cylinder, wherein the top surface of the cylindrical substrate is an upper base of the solid right circular cylinder, and wherein the bottom surface of the cylindrical substrate is a lower base of the solid right circular cylinder.

9. The cutter of claim 1, wherein the top surface of the cylindrical substrate comprises a support surface, wherein the cutting table coupled to the cylindrical substrate comprises a bottom surface of the cutting table coupled to the support surface, and wherein the superhard material comprises a Vickers hardness of at least 70 GPa.

10. The cutter of claim 9, wherein the conical frustum having a slant height sloping outwardly from a central axis of the cylindrical substrate along the direction away from the cylindrical substrate, wherein diameter of the cutting face is greater than diameter of the support surface, and wherein coupled comprises the bottom surface of the cutting table sintered to the support surface.

11. The cutter of claim 1, wherein coupled comprises the top surface of the cylindrical substrate sintered to a bottom surface of the cutting table, wherein the cylindrical substrate is a solid right circular cylinder, wherein the bottom surface of the cylindrical substrate is a base of the solid right circular cylinder, wherein the conical frustum tapers toward the cylindrical substrate, and wherein the cutting face greater in diameter than the support surface and the cylindrical substrate.

12. The cutter of claim 1, wherein the cutter is a fixed cutter for the drill bit as a fixed cutter bit to drill a wellbore in the formation, wherein the cutter does not move relative to the drill bit in operation, wherein the cutting table increasing in width to maintain a Bakr angle of the cutting table with respect to a surface of the formation greater than back rake, and wherein the cutting table coupled to the top surface of the cylindrical substrate comprises a bottom surface of the cutting table sintered to the top surface of the cylindrical substrate.

13. The cutter of claim 1, wherein the shape of the conical frustum comprises a shape of a truncated right circular cone inverted with respect to the substrate, and wherein the cutting face greater in diameter than the cylindrical substrate.

14. The cutter of claim 13, wherein the cutting face greater in diameter than the cylindrical substrate to provide for a specified value of a Bakr angle of the cutter with respect to a surface of the formation during drilling and for a specified amount of elevation of the cylindrical substrate above the surface during drilling.

15. The cutter of claim 1, wherein the width comprises diameter, wherein the cutting table comprising a shape of the conical frustum comprises a shape of a truncated right circular cone having a first base and a second base larger in diameter than the first base, the first base coupled to the cylindrical substrate, and the second base comprising the cutting face larger in diameter than diameter of the cylindrical substrate.

16. A drill bit that is a fixed cutter bit for drilling into a formation, comprising:

a plurality of cutters that does not move relative to the drill bit in operation, each cutter comprising:

a substrate comprising a support surface; and a cutting table comprising polycrystalline diamond (PCD) and coupled to the support surface, wherein a side of the cutting table along a direction opposite the substrate slopes outward such that a cutting face of the cutting table is greater in diameter than the support surface, and wherein the support surface comprises a top surface of the substrate that is equal in diameter to a bottom surface of the substrate.

17. The drill bit of claim 16, wherein the cutting table and the substrate share a central axis, wherein the cutting table is a shape of a frustum of a right circular cone from the cutting face to the support surface, wherein the cutting table coupled to the support surface comprises a bottom surface of the cutting table sintered to the support surface, and wherein the substrate is a cylindrical substrate.

18. The drill bit of claim 16, wherein the substrate is a solid right cylinder, wherein the cutting table comprises a shape of a conical frustum that tapers toward the substrate, and wherein diameter of a smaller base of the conical frustum is equal to diameter of the support surface.

19. The drill bit of claim 16, wherein the cutting table is a conical frustum that is a truncated right circular cone inverted with respect to the substrate, wherein the substrate is a cylindrical substrate comprising the top surface, the bottom surface, and a side surface extending from the top surface to the bottom surface, wherein circumference of the top surface is equal to circumference of the bottom surface.

20. The drill bit of claim 16, wherein the cutting table comprises a shape of a frustum of a right circular cone, wherein the cutting table coupled to the support surface comprises a first base of the frustum coupled to the support surface, and wherein the cutting table comprises a cutting face comprising a second base of the frustum larger in diameter than the first base and the support surface.

21. A method of manufacturing a polycrystalline diamond compact (PDC) cutter for a drill bit, the PCD cutter comprising a cutting table and a cylindrical substrate, the method comprising coupling the cutting table to a top surface of the cylindrical substrate, wherein the cutting table increases in diameter in a direction away from the cylindrical substrate, wherein a cutting face of the cutting table is greater in diameter than the cylindrical substrate, wherein the top surface of the cylindrical substrate is equal in diameter to a bottom surface of the cylindrical substrate, and wherein the cutting table from the cylindrical substrate to the cutting surface is a shape of a conical frustum that is a frustum of a right circular cone.

22. The method of claim 21, wherein the direction away from the cylindrical substrate is along a central axis of the cutting table and of the cylindrical substrate, wherein the conical frustum has a straight side that slopes outward from the central axis along the direction.

23. The method of claim 21, wherein the top surface of the cylindrical substrate comprises a circular support surface, wherein shape of the conical frustum tapers toward the cylindrical substrate, and wherein coupling comprises sintering the cutting table to the circular support surface.

24. The method of claim 23, comprising receiving the cylindrical substrate as a right solid cylinder and forming the cutting table, wherein sintering comprising sintering a bottom surface of the cutting table comprising a smaller base of the conical frustum to the circular support surface.

25. A method of drilling a hole in a formation, comprising:

lowering a drill bit that is a fixed cutter bit having a cutter into the formation, the cutter comprising a cutting table coupled to a top surface of a cylindrical substrate, wherein the cutting table comprises polycrystalline diamond (PCD) and increases in diameter along a direction away from the cylindrical substrate, and wherein the top surface of the cylindrical substrate is equal in diameter to a bottom surface of the cylindrical substrate;

rotating the drill bit to drill the hole in the formation, wherein the cutter does not move relative to the drill bit;

maintaining a Bakr angle of the cutter with respect to a surface of the formation greater than a back rake angle of the cutter with respect to the surface; and removing formation rock cuttings from the formation.

26. The method of claim 25, wherein the drill bit comprises a polycrystalline diamond compact (PDC) drill bit and the cutter comprises a PDC cutter, wherein the cutting table comprises a cutting face having a diameter greater than a diameter of the cylindrical substrate, and wherein the cutting table comprises a shape of a conical frustum that is a frustum of a right circular cone having a straight side that tapers along a direction toward the cylindrical substrate.

27. The method of claim 25, comprising maintaining the back rake angle at less than 12 degrees, wherein maintaining the Bakr angle comprises maintaining the Bakr angle at 13 degrees or greater, and wherein the cutting table comprises a shape of a conical frustum inverted with respect to the cylindrical substrate.

28. The method of claim 25, wherein the cylindrical substrate is a solid right circular cylinder, wherein the top surface of the cylindrical substrate is circular and the bottom surface of the cylindrical substrate is circular, and wherein the cutting table is an inverted conical frustum from the cylindrical substrate to a cutting face of the cutting table.

* * * * *